US009386803B2

(12) United States Patent
Burke et al.

(10) Patent No.: US 9,386,803 B2
(45) Date of Patent: Jul. 12, 2016

(54) TOBACCO SMOKE FILTER FOR SMOKING DEVICE WITH POROUS MASS OF ACTIVE PARTICULATE

(75) Inventors: Peter Burke, Chester (GB); Meinhard Gusik, Oberhausen (DE); Julia Hufen, Rheinberg (DE); Luis Jimenez, Blacksburg, VA (US); Raymond Robertson, Blacksburg, VA (US); Ramesh Srinivasan, Cincinnati, OH (US)

(73) Assignee: Celanese Acetate LLC, Dallas, TX (US)

( * ) Notice: Subject to any disclaimer, the term of this patent is extended or adjusted under 35 U.S.C. 154(b) by 1171 days.

(21) Appl. No.: 12/981,909

(22) Filed: Dec. 30, 2010

(65) Prior Publication Data

US 2011/0162667 A1 Jul. 7, 2011

Related U.S. Application Data

(60) Provisional application No. 61/292,530, filed on Jan. 6, 2010, provisional application No. 61/390,211, filed on Oct. 6, 2010.

(51) Int. Cl.

| | |
|---|---|
| ***A24D 3/12*** | (2006.01) |
| ***A24D 3/06*** | (2006.01) |
| ***A24D 3/08*** | (2006.01) |
| ***A24D 3/16*** | (2006.01) |
| ***D04H 1/407*** | (2012.01) |
| ***A24D 3/14*** | (2006.01) |

(52) U.S. Cl.

CPC *A24D 3/12* (2013.01); *A24D 3/062* (2013.01); *A24D 3/066* (2013.01); *A24D 3/08* (2013.01); *A24D 3/14* (2013.01); *A24D 3/163* (2013.01); *D04H 1/407* (2013.01)

(58) Field of Classification Search

CPC ..... A24D 3/062; A24D 3/066; A24D 3/08; A24D 3/14; A24D 3/163; A24D 3/12; D04H 1/407

See application file for complete search history.

(56) References Cited

U.S. PATENT DOCUMENTS

| | | | | |
|---|---|---|---|---|
| 2,957,285 | A | 10/1960 | Molins | |
| 3,217,715 | A * | 11/1965 | Berger et al. | 131/342 |
| 3,217,718 | A | 11/1965 | Roberts | |
| 3,318,317 | A | 5/1967 | Sproull et al. | |
| 3,353,543 | A | 11/1967 | Sproull et al. | |
| 3,354,886 | A | 11/1967 | Berger et al. | |
| 3,400,032 | A | 9/1968 | Sexstone et al. | |
| 3,403,202 | A | 9/1968 | Green | |
| 3,409,020 | A | 11/1968 | Westbrook et al. | |
| 3,474,600 | A | 10/1969 | Tobias | |
| 3,483,331 | A | 12/1969 | Hasser | |
| 3,516,885 | A | 6/1970 | Sexstone et al. | |
| 3,531,558 | A | 9/1970 | Ganz | |
| 3,648,711 | A | 3/1972 | Berger et al. | |
| 3,807,286 | A | 4/1974 | Sexstone | |
| 4,090,424 | A | 5/1978 | Hall | |
| 4,156,431 | A | 5/1979 | Epstein et al. | |
| 4,257,754 | A | 3/1981 | Green et al. | |
| 4,379,465 | A | 4/1983 | Coq | |
| 4,516,589 | A | 5/1985 | Rainer et al. | |
| 4,664,683 | A | 5/1987 | Degen et al. | |
| 4,753,728 | A | 6/1988 | VanderBilt et al. | |
| 4,807,647 | A | 2/1989 | Hayes | |
| 5,047,180 | A | 9/1991 | Steiner et al. | |
| 5,064,949 | A | 11/1991 | Steiner et al. | |
| 5,423,336 | A | 6/1995 | Mentzel et al. | |
| 6,080,457 | A | 6/2000 | Charlton et al. | |
| 6,145,511 | A | 11/2000 | Teufel et al. | |
| 6,225,812 | B1 | 5/2001 | Mays et al. | |
| 6,630,016 | B2 | 10/2003 | Koslow | |
| 6,762,139 | B2 | 7/2004 | Strommen | |
| 6,770,736 | B1 * | 8/2004 | Haftka et al. | 528/396 |
| 6,846,869 | B2 | 1/2005 | Clark et al. | |
| 6,989,101 | B2 | 1/2006 | Cumberland et al. | |
| 7,018,582 | B2 | 3/2006 | Lewis | |
| 7,049,382 | B2 | 5/2006 | Haftka et al. | |
| 7,112,272 | B2 | 9/2006 | Hughes et al. | |
| 7,112,280 | B2 | 9/2006 | Hughes et al. | |
| 7,141,636 | B1 | 11/2006 | Ehlers et al. | |
| 7,160,453 | B1 | 1/2007 | Matsumura et al. | |
| 7,169,304 | B2 | 1/2007 | Hughes et al. | |

(Continued)

FOREIGN PATENT DOCUMENTS

| | | | |
|---|---|---|---|
| CA | 2330782 | A1 | 7/2002 |
| EA | 2006/02054 | A1 | 12/2007 |

(Continued)

OTHER PUBLICATIONS

Official Action for Canadian Patent Application 2,813,575 dated Sep. 19, 2014.

Search Report and Written Opinion for Singapore Application No. 2013025192 dated Sep. 26, 2014.

Official Action for Japanese Patent Application No. 2013-534041 dated Sep. 24, 2014.

Official Action for Chinese Application No. 201280003756.0 dated Sep. 19, 2014.

International Search Report and Written Opinion for PCT/US2013/064269 dated Jan. 16, 2014.

Official Action for Russian Patent Application No. 10-2013-7012260 dated Jan. 29, 2014.

Official Action for Chinese Application No. 201280003756.0 dated Feb. 11, 2014.

Official Action for Canadian Patent Application No. 2,814,074 dated Feb. 6, 2014.

(Continued)

*Primary Examiner* — Michael H Wilson

*Assistant Examiner* — Dionne Walls Mayes

(74) *Attorney, Agent, or Firm* — McDermott Will & Emery LLP

(57) ABSTRACT

A tobacco smoking device comprises a porous mass of active particles adapted to enhance a tobacco smoke flowing over said active particles and binder particles. The active particles comprises about 1-99% weight of the porous mass, and the binder particles comprises about 1-99% weight of said porous mass. The active particles and said binder particles are bound together at randomly distributed points throughout the porous mass. The active particles have a greater particle size than the binder particles.

53 Claims, 1 Drawing Sheet

(56) References Cited

U.S. PATENT DOCUMENTS

| | | | |
|---|---|---|---|
| 7,293,661 | B2 | 11/2007 | Saaski et al. |
| 7,374,680 | B2 | 5/2008 | Hughes et al. |
| 7,806,817 | B2 | 10/2010 | Day et al. |
| 8,047,977 | B2 | 11/2011 | Lauenstein et al. |
| 9,027,566 | B2 | 5/2015 | Garrett et al. |
| 9,138,017 | B2 | 9/2015 | Garrett et al. |
| 9,149,069 | B2 | 10/2015 | Garrett et al. |
| 2002/0153017 | A1 | 10/2002 | Georgitsis et al. |
| 2002/0166564 | A1 | 11/2002 | Sung |
| 2003/0000538 | A1 | 1/2003 | Bereman |
| 2004/0043717 | A1 | 3/2004 | Shefet |
| 2004/0043718 | A1 | 3/2004 | Shefet |
| 2004/0046289 | A1 | 3/2004 | Stadermann et al. |
| 2004/0194792 | A1 | 10/2004 | Zhuang et al. |
| 2004/0235631 | A1 | 11/2004 | Buhl et al. |
| 2004/0250822 | A1 | 12/2004 | Gosebruch |
| 2004/0250827 | A1 | 12/2004 | Deevi et al. |
| 2005/0004299 | A1 | 1/2005 | Haftka et al. |
| 2005/0133052 | A1 | 6/2005 | Fournier et al. |
| 2005/0199251 | A1 | 9/2005 | Wonowidjojo et al. |
| 2005/0279372 | A1 | 12/2005 | Sundar et al. |
| 2006/0086366 | A1 | 4/2006 | Xue et al. |
| 2006/0130856 | A1 | 6/2006 | McCormack |
| 2006/0174902 | A1 | 8/2006 | Zhou et al. |
| 2007/0095358 | A1 | 5/2007 | Li et al. |
| 2007/0225390 | A1 | 9/2007 | Wang et al. |
| 2008/0090081 | A1 | 4/2008 | Matsumoto et al. |
| 2008/0173320 | A1* | 7/2008 | Dunlap et al. ..... 131/365 |
| 2008/0264594 | A1 | 10/2008 | Lohmueller et al. |
| 2009/0288671 | A1 | 11/2009 | White et al. |
| 2010/0125039 | A1 | 5/2010 | Banerjee et al. |
| 2010/0147317 | A1 | 6/2010 | Fallon |
| 2010/0176068 | A1 | 7/2010 | Dallas et al. |
| 2011/0162667 | A1 | 7/2011 | Burke et al. |
| 2013/0030340 | A1 | 1/2013 | Vincent et al. |
| 2013/0214447 | A1 | 8/2013 | Garrett et al. |
| 2013/0221562 | A1 | 8/2013 | Garrett et al. |
| 2013/0221563 | A1 | 8/2013 | Garrett et al. |
| 2013/0239983 | A1 | 9/2013 | Burke et al. |
| 2013/0298923 | A1 | 11/2013 | Garrett et al. |
| 2014/0007893 | A1 | 1/2014 | Burke et al. |
| 2014/0070465 | A1 | 3/2014 | Kizer et al. |

FOREIGN PATENT DOCUMENTS

| | | | |
|---|---|---|---|
| GB | 1030680 | | 5/1966 |
| GB | 1030680 | A | 5/1966 |
| GB | 1059421 | | 2/1967 |
| GB | 1059421 | A | 2/1967 |
| GB | 1104993 | A | 3/1968 |
| GB | 2010067 | A | 6/1979 |
| GB | 2030440 | A | 4/1980 |
| GB | 1592952 | | 7/1981 |
| GB | 1592952 | A | 7/1981 |
| GB | 2077272 | A | 12/1981 |
| JP | 61210917 | | 3/1988 |
| JP | 199017989 | | 1/1990 |
| JP | 2000342916 | A | 12/2000 |
| JP | 2001187305 | A | 7/2001 |
| JP | 2002512012 | A | 4/2002 |
| JP | 2002257888 | A | 9/2002 |
| JP | 2002355512 | A | 12/2002 |
| JP | 2007-008158 | A | 1/2007 |
| JP | 2007527698 | A | 10/2007 |
| JP | 2010035550 | A | 2/2010 |
| WO | 9404968 | A1 | 3/1994 |
| WO | 9639054 | A1 | 12/1996 |
| WO | 9953778 | A2 | 10/1999 |
| WO | 00/18810 | A2 | 4/2000 |
| WO | 03039277 | A1 | 5/2003 |
| WO | 2004110186 | A1 | 12/2004 |
| WO | 2008142420 | A1 | 11/2008 |
| WO | 2009112591 | A2 | 9/2009 |
| WO | WO 2009112591 | | 9/2009 |
| WO | 2011034947 | A2 | 3/2011 |
| WO | 2011084907 | A1 | 7/2011 |
| WO | 2011121358 | A1 | 10/2011 |
| WO | 2011140053 | A1 | 11/2011 |
| WO | 2012006478 | A2 | 1/2012 |
| WO | 2012047346 | A1 | 4/2012 |
| WO | 2012047347 | A1 | 4/2012 |
| WO | 2012047348 | A1 | 4/2012 |
| WO | 2012047349 | A1 | 4/2012 |
| WO | 2012051548 | A2 | 4/2012 |
| WO | 2012054111 | A1 | 4/2012 |
| WO | 2013066589 | A1 | 5/2013 |
| WO | 2014022544 | A1 | 2/2014 |

OTHER PUBLICATIONS

Official Action for JP Patent Application No. 2013-534041 dated Oct. 15, 2013.

Barrera et al., "Melt Flow Index on High Molecular Weight Polyethylene: A Comparative Study of Experiments and Simulation," Journal of Materials Processing Technology, 174 (2006), 171-177.

Official Action for Canadian Patent Application 2813575 dated Oct. 2013.

Official Action for Chinese Patent Application 201180054836.4 dated Jan. 2014.

Official Action for Chinese Patent Application 201280003756.0 dated Feb. 2014.

Official Action for European Patent Application EP 13168042 dated Jan. 2014.

International Search Report and Written Opinion for PCT/US2011/034947 dated Jul. 22, 2011.

International Search Report and Written Opinion for PCT/US2011/043264 dated Nov. 21, 2011.

International Search Report and Written Opinion for PCT/US2011/043268 dated Dec. 8, 2011.

International Search Report and Written Opinion for PCT/US2011/043269 dated Nov. 21, 2011.

International Search Report and Written Opinion for PCT/US2011/043271 dated Jan. 18, 2012.

International Search Report and Written Opinion for PCT/US2011/044142 dated Dec. 6, 2011.

International Search Report and Written Opinion for PCT/US2011/056388 dated May 24, 2012.

International Search Report and Written Opinion for PCT/US2011/020013 dated Mar. 10, 2011.

International Search Report and Written Opinion for PCT/US2013/052993 dated Nov. 4, 2013.

Official Action for EP 11834774.9 dated Mar. 13, 2014.

Official Action for Korean Patent Application KR 10-2013-7011521 dated Mar. 2014.

Official Action for JP Patent Application No. 2013-542267 dated Jul. 8, 2014.

POLYOX™, Physico-Mechanical Characterization of POLYOX™ for Tablet Manufacture, Colorcon, 2009.

Columbia Activated Carbon, Supplement to Catalog Section S-6450, Data Sheet No. 12, Union Carbide, 1962.

Official Action for Chinese Patent Application No. 201310273059.3 dated May 5, 2014.

Official Action for Singapore Patent Application No. 2013026364 dated Apr. 3, 2014.

UHMW (Ultra Hiigh Molecular Weight Polyethylene), Product Information Sheet, Poly-Tech Industrial, Inc. 2011, [online], Retrieved from the Internet, [retrieved on Jul. 2, 2014], URL: http://www.polytechindustrial.com/products/plastic-stock-shapes/uhmw-polyethylene.

BAT Bondex Sbtb55a99—Bondex Filter Rods Using Polythene Plus Trisodium Orthophosphate 12H20 as a Bonding Agent, Confidential File Note No. 0709, 1966.

Summary of American Filtrona and B & W Bonded Charcoal Filter Patents Covering Products, Apparatus and Methods, not dated.

Announcing New Tempo Filter Cigarettes . . . First With the New Bonded Charcoal Filter, Ad No. 138-101A, 1964.

Memo dated Jun. 28, 1965 from J.E. Wickham to Mr. F.E. Resnik re: Polyethylene in Tempo and Sano Filters.

Table I, New or Modified Cigarettes in 1964.

(56) References Cited

OTHER PUBLICATIONS

Memo from V.C. Johnson to Mr. F.E. Resnik dated Mar. 29, 1965 re: Sano and Tempo Bonded Carbon Filters.
C.I. Report No. 2-65 dated Feb. 28, 1965.
Memo from V.C. Johnson to Mr. J.S. Osmalov (6) dated Nov. 24, 1964 re.: P.M. Bonded Carbon Cigarette Filters vs. Tempo Bonded Carbon Filter Rods.
Official Action for Chinese Application No. 201310273059.3 dated Dec. 10, 2014.
Official Action for JP Patent Application No. 2013-532798 dated Jan. 20, 2015.
Theory of Cigarette Smoke Filtration, report, R.J. Reynolds collection, Legacy Tobacco Documents Library, University of CA, San Francisco, 1995, [online], retrieved from the Internet, [retrieved Jan. 30, 2015], http://legacy.library.ucsf.edu/tid/pmc01d00/pdf.
Official Action for European Patent Application No. 12846228.0 dated May 19, 2015.
Official Action for Chilean Patent Application No. 1016-2013 dated Oct. 13, 2015.

* cited by examiner

TOBACCO SMOKE FILTER FOR SMOKING DEVICE WITH POROUS MASS OF ACTIVE PARTICULATE

RELATED APPLICATION

The instant application claims the benefit of U.S. Provisional Application Ser. Nos. 61/292,530 filed Jan. 6, 2010 and 61/390,211 filed Oct. 6, 2010.

FIELD OF THE INVENTION

The instant application is directed to a tobacco smoke filter for a smoking device having an element that enhances the smoke flowing thereover.

BACKGROUND OF THE INVENTION

The World Health Organization (WHO) has set forth recommendations for the reduction of certain components of tobacco smoke. See: WHO Technical Report Series No. 951, *The Scientific Basis of Tobacco Product Regulation*, World Health Organization (2008). Therein, the WHO recommends that certain components, such as acetaldehyde, acrolein, benzene, benzo[a]pyrene, 1,3-butadiene, and formaldehyde, among others, be reduced to a level below 1250 of the median values of the data set. Ibid., Table 3.10, page 112. In view of new international recommendations related to tobacco product regulation, there is a need for new tobacco smoke filters and materials used to make tobacco smoke filters.

The use of carbon loaded tobacco smoke filters for removing tobacco smoke components is known. These filters include carbon-on-tow filters and carbon particulate contained within chambers of the filter. U.S. Pat. No. 5,423,336 discloses a cigarette filter with a chamber loaded with activated carbon. US Publication No. 2010/0147317 discloses a cigarette filter with a spiral channel where activated carbon is adhered to the channel's walls. GB1592952 discloses a cigarette filter where a body of continuous filaments surrounds a core of sorbent particles (e.g., activated carbon) bonded together with a thermoplastic binder (e.g., polyethylene and polypropylene). WO 2008/142420 discloses a cigarette filter where the absorbent material (e.g., activated carbon) is coated with a polymer material (e.g., 0.4-5 wt % polyethylene). WO 2009/112591 discloses a cigarette filter that produces little to no dust with a composite material comprising at least one polymer (e.g., polyethylene) and at least one other compound (e.g., activated carbon).

Carbon block technology where activated carbon is formed into a monolithic porous block with a binder is known. In U.S. Pat. Nos. 4,753,728, 6,770,736, 7,049,382, 7,160,453, and 7,112,280, carbon block technology, using low melt flow polymer binders, are principally used as water filters.

In the mid 1960's to the mid 1970's, attempts were made to use porous blocks of activated carbon particles bonded together with commercial thermoplastics (i.e., polyethylene and polypropylene), see GB1059421, GB1030680, U.S. Pat. No. 3,353,543, U.S. Pat. No. 3,217,715, U.S. Pat. No. 3,474,600, U.S. Pat. No. 3,648,711, and GB1592952. Several of these porous blocks are used in cigarette filters. But, none of them mentions the use of low melt flow polymers. Moreover, these carbon blocks do not appear to have been commercialized or commercialized successfully. One suggestion for the failure of the technology is that the use of high melt flow polymers would result in such block-to-block variation in product performance (e.g., pressure drop and smoke component removal) and therefore, they would be useless in the mass production of cigarettes. In cigarette production, uniformity of the cigarette components is a necessity. The use of high melt flow polymers are also known to mask the carbon, thereby reducing the available effective surface area rendering the carbon highly ineffective.

Accordingly, there is a need for a porous mass of active particulate that can be used in a tobacco smoke filter.

SUMMARY OF THE INVENTION

A tobacco smoking device comprises a porous mass of active particles adapted to enhance a tobacco smoke flowing over said active particles and binder particles. The active particles comprises about 1-99% weight of the porous mass, and the binder particles comprises about 1-99% weight of said porous mass. The active particles and said binder particles are bound together at randomly distributed points throughout the porous mass. The active particles have a greater particle size than the binder particles.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

The porous mass described hereinafter is used with a smoking device, particularly a tobacco smoking device. The porous mass may form a portion of the filter section of the smoking device.

Referring to FIGS. 1-4, there is shown several embodiments of a smoking device (these are representative, but not limiting on the smoking devices comtemplated hereinafter). Smoking device, as used herein, most often refers to a cigarette, but it is not so limited and could be used with other smoking devices, such as cigarette holders, cigars, cigar holders, pipes, water pipes, hookahs, electronic smoking devices, smokeless smoking devices, etc. Hereinafter, reference will be to a cigarette (unless otherwise specified).

Figure 1:
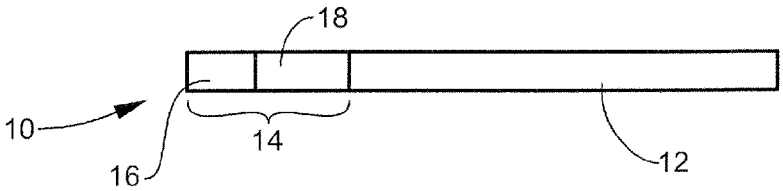
FIG. 1 is a cross-sectional view of an embodiment of a cigarette including the inventive smoke filter.

In FIG. 1, cigarette 10 includes a tobacco column 12 and a filter 14. Filter 14 may comprise at least two sections, first section 16 and second section 18. For example, the first section 16 may comprise conventional filter material (discussed in greater detail below) and the second section 18 comprises a porous mass (discussed in greater detail below).

Figure 2:
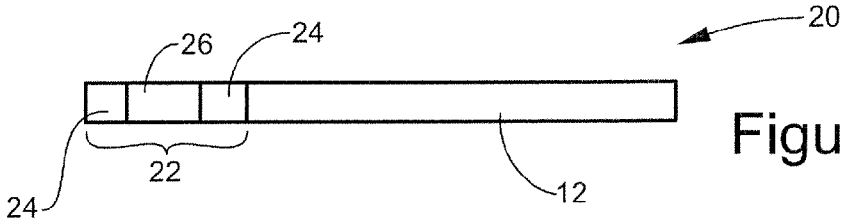
FIG. 2 is a cross-sectional view of another embodiment of a cigarette including the inventive smoke filter.

In FIG. 2, cigarette 20 has a tobacco column 12 and filter 22. Filter 22 is multi-segmented with three sections. In this embodiment, conventional filter materials 24 may flank the porous mass 26.

Figure 3:
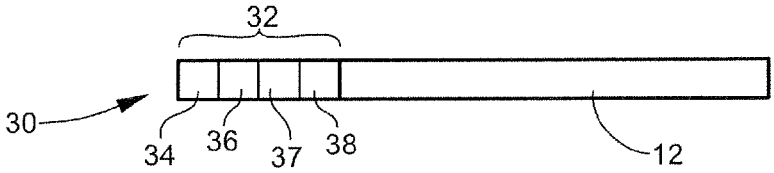
FIG. 3 is a cross-sectional view of another embodiment of a cigarette including the inventive smoke filter.

In FIG. 3, cigarette 30 has a tobacco column 12 and a filter 32. Filter 32 is multi-segmented with four sections. In this embodiment, end section 34 is a conventional material, but sections 36, 37, and 38 may be any combination of conventional materials and porous mass (so long as at least one of those sections is the porous mass).

The foregoing embodiments are representative and not limiting. Of course, the inventive filters may have any number of sections, for example, 2, 3, 4, 5, 6, or more sections. Moreover, the sections may be the same as one another or different from one another. The filters may have a diameter in the range of 5-10 mm and a length of 5-30 mm.

Figure 4:
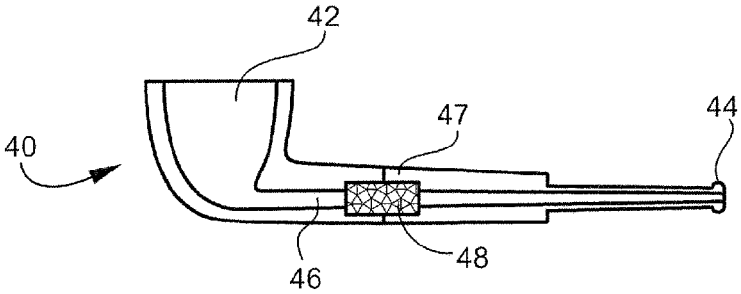
FIG. 4 is a cross-sectional view of a smoking device including the inventive smoke filter.

In FIG. 4, a pipe 40 has a burning bowl 42, a mouth piece 44, and a channel 46 interconnecting bowl 42 and mouth piece 44. Channel 46 includes a cavity 47. Cavity 47 is adapted for receipt of a filter 48. Filter 48 may be a multi-segmented filter as discussed above or may consist solely of the porous mass.

In the foregoing embodiments, the conventional materials and porous mass are joined. Joined, as used herein, means that the porous mass is in-line (or in series) with the tobacco column; so, that when the cigarette is smoked, smoke from the tobacco column must pass through (e.g., in series) the porous mass and, most often, through both the porous mass and the conventional filter materials. As shown in FIGS. 1-3, the porous mass and the conventional filter materials are co-axial, juxtaposed, abutting, and have equivalent cross-sectional areas (or substantially equivalent cross-sectional areas). But, it is understood that the porous mass and the conventional materials need not be joined in such a fashion, and that there may be other possible configurations. Moreover, while, it is envisioned that porous mass will be, most often, used in a combined or multi-segmented cigarette filter configuration, as shown in FIGS. 1-3; the invention is not so limited and the filter may comprise only the porous mass, as discussed above with regard to FIG. 4. Further, while it is envisioned that the porous mass will be juxtaposed to the tobacco column, as shown in FIG. 1, it is not so limited. For example, the porous mass may be separated from the tobacco by a hollow cavity (e.g., a tube or channel, such as in a pipe or hookah or a cigarette or cigar holder), for example see FIG. 4.

The conventional filter materials include, but are not limited to, fibrous tows (e.g., cellulose acetate tow, polyolefin tow, and combinations thereof), paper, void chambers (e.g., formed by rigid elements, such as paper or plastic), baffled void chambers, and combinations thereof. Also included are fibrous tows and papers with active ingredients (adhered thereto or impregnated therein or otherwise incorporated therewith). Such active materials include activated carbon (or charcoal), ion exchange resins, desiccants, or other materials adapted to affect the tobacco smoke. The void chambers may be filled (or partially filled) with active ingredients or materials incorporating the active ingredients. Such active ingredients include activated carbon (or charcoal), ion exchange resins, desiccants, or other materials adapted to affect the tobacco smoke. Additionally, the conventional material may be a porous mass of binder particles (i.e., binder particles alone without any active particles). For example, this porous mass without active particles may be made with thermoplastic particles (such as polyolefin powders, including the binder particles discussed below) that are bonded or molded together into a porous cylindrical shape.

Figure 5:
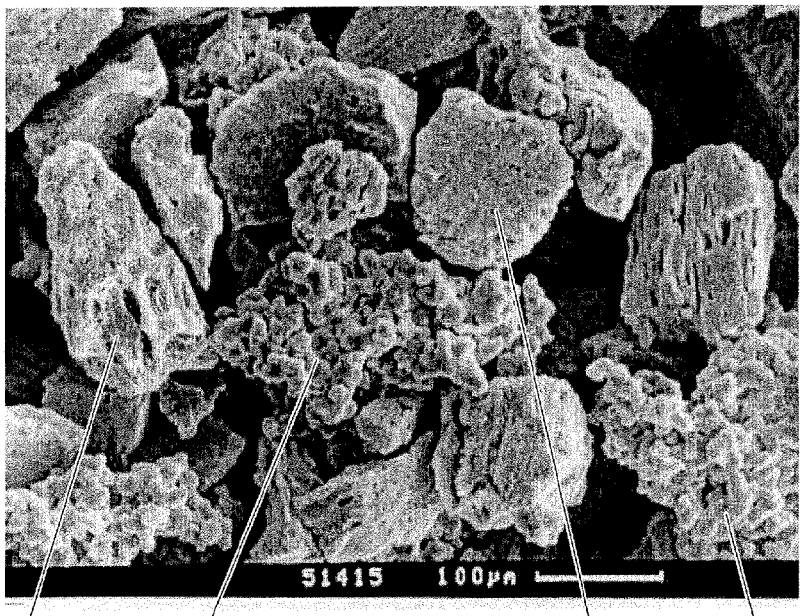
FIG. 5 is a photomicrograph of a section of the porous mass.

The porous mass comprises active particles bonded together with binder particles. For example, see FIG. 5, a photomicrograph of an embodiment of the porous mass where active particles (e.g., activated carbon particles) 50 are bonded into the porous mass by binder particles 52. (The active particles and the binder particles are discussed in greater detail below.) This porous mass is constructed so that it has a minimal encapsulated pressure drop (i.e., loss of pressure while traveling through the porous mass) while maximizing the active particles surface area (i.e., functionality of the active particle is increased by exposing the surface area of those particles). Note: in this embodiment (FIG. 5), binder particles and active particles are joined at points of contact, the points of contact are randomly distributed throughout the porous mass, and the binder particles have retained their original physical shape (or substantially retained their original shape, e.g., no more that 10% variation (e.g., shrinkage) in shape from original).

There may be any weight ratio of active particles to binder particles in the porous mass. The ratio may be 1-99 weight % active particles and 99-1 weight % binder particles. The ratio may be 25-99 weight %, active particles and 1-75 weight % binder particles. The ratio may be 40-99 weight active particles and 1-60 weight % binder particles. In one embodiment of the porous mass, the active particles comprise 50-99 weight % of the mass while the binder particles comprise 1-50 weight % of the mass. In another embodiment, the active particles comprise 60-95 weight % of the mass while the binder particles comprise 5-40 weight % of the mass. And, in yet another embodiment, the active particles comprise 75-90 weight % of the mass while the binder particles comprise 10-25 weight % of the mass.

In one embodiment of the porous mass, the porous mass has a void volume in the range of 40-90%. In another embodiment, it has a void volume of 60-90%. In yet another embodiment, it has a void volume of 60-85%. Void volume is the free space between the active particles and the binder particles after the porous mass is formed.

In one embodiment of the porous mass, the porous mass has an encapsulated pressure drop (EPD) in the range of 0.50-25 mm of water per mm length of porous mass. In another embodiment, it has an EPD in the range of 0.50-10 mm of water per mm length of porous mass. And, in yet another embodiment, it has an EPD of 2-7 mm of water per mm length of porous mass (or no greater than 7 mm of water per mm length of porous mass). To obtain the desired EPD, the active particles must have a greater particle size than the binder particles. In one embodiment, the ratio of binder particle size to active particle size is in the range of about 1:1.5-4.0.

In one embodiment, the porous mass has a length of 2-12 mm. In another, the porous mass has a length of 4-10 mm.

The porous mass may have any physical shape; in one embodiment, it is in the shape of a cylinder.

The active particles may be any material adapted to enhance smoke flowing thereover. Adapted to enhance smoke flowing thereover refers to any material that can remove or add components to smoke. The removal may be selective. In tobacco smoke from a cigarette, carbonyls (e.g., formaldehyde, acetaldhyde, acetone, propionaldehyde, crotonaldehyde, butyraldehyde, methyl ethyl ketone, acrolein) and other compounds (e.g., benzene, 1,3 butadiene, and benzo[a] pyrene (or BaPyrene)), for example, may be selectively removed. One example of such a material is activated carbon (or activated charcoal or actived coal). The activated carbon may be low activity (50-75% $CCl_4$ adsorption) or high activity (75-95% $CCl_4$ adsorption) or a combination of both. Other examples of such materials include ion exchange resins, desiccants, silicates, molecular sieves, silica gels, activated alumina, perlite, sepiolite, Fuller's Earth, magnesium silicate, metal oxides (e.g., iron oxide), and combinations of the foregoing (including activated carbon). Ion exchange resins include, for example, a polymer with a backbone, such as styrene-divinyl benezene (DVB) copolymer, acrylates, methacrylates, phenol formaldehyde condensates, and epichlorohydrin amine condensates; and a plurality of electrically charged functional groups attached to the polymer backbone. In one embodiment, the active particles are combination of various active particles.

In one embodiment, the active particles have a particle size in the range of 0.5-5000 microns. In another embodiment, the particle size may range from 10-1000 microns. In another embodiment, the particle size may range from 200-900 microns. In another embodiment, the active particles may be a mixture of various particle sizes. In another embodiment, the active particles may be a mixture of various particle sizes with an average particle size in the range of 0.5-5000 microns or 10-1000 microns or 200-900 microns.

The binder particles may be any binder particles. In one embodiment, the binder particles exhibit virtually no flow at its melting temperature. This means a material that when heated to its melting temperature exhibits little to no polymer flow. Materials meeting these criteria include, but are not limited to, ultrahigh molecular weight polyethylene, very high molecular weight polyethylene, high molecular weight polyethylene, and combinations thereof. In one embodiment, the binder particles have a melt flow index (MFI, ASTM D1238) of less than or equal to 3.5 g/10 min at 190° C. and 15 Kg (or 0-3.5 g/10 min at 190° C. and 15 Kg). In another embodiment, the binder particles have a melt flow index (MFI) of less than or equal to 2.0 g/10 min at 190° C. and 15 Kg (or 0-2.0 g/10 min at 190° C. and 15 Kg). One example of such a material is ultra high molecular weight polyethylene, UHMWPE (which has no polymer flow, MFI≈0, at 190° C. and 15 Kg, or an MFI of 0-1.0 at 190° C. and 15 Kg); another material may be very high molecular weight polyethylene, VHMWPE (which may have MFIs in the range of, for example, 1.0-2.0 g/10 min at 190° C. and 15 Kg); or high molecular weight polyethylene, HMWPE (which may have MFIs of, for example, 2.0-3.5 g/10 min at 190° C. and 15 Kg).

In terms of molecular weight, "ultra-high molecular weight polyethylene" as used herein refers to polyethylene compositions with weight-average molecular weight of at least about $3\times10^6$ g/mol. In some embodiments, the molecular weight of the ultra-high molecular weight polyethylene composition is between about $3\times10^6$ g/mol and about $30\times10^6$ g/mol, or between about $3\times10^6$ g/mol and about $20\times10^6$ g/mol, or between about $3\times10^6$ g/mol and about $10\times10^6$ g/mol, or between about $3\times10^6$ g/mol and about $6\times10^6$ g/mol. "Very-high molecular weight polyethylene" refers to polyethylene compositions with a weight average molecular weight of less than about $3\times10^6$ g/mol and more than about $1\times10^6$ g/mol. In some embodiments, the molecular weight of the very-high molecular weight polyethylene composition is between about $2\times10^6$ g/mol and less than about $3\times10^6$ g/mol. "High molecular weight polyethylene" refers to polyethylene compositions with weight-average molecular weight of at least about $3\times10^5$ g/mol to $1\times10^6$ g/mol. For purposes of the present specification, the molecular weights referenced herein are determined in accordance with the Margolies equation ("Margolies molecular weight").

Suitable polyethylene materials are commercially available from several sources including GUR® UHMWPE from Ticona Polymers LLC, a division of Celanese Corporation of Dallas, Tex., and DSM (Netherland), Braskem (Brazil), Beijing Factory No. 2 (BAAF), Shanghai Chemical, and Qilu (People's Republic of China), Mitsui and Asahi (Japan). Specifically, GUR polymers may include: GUR 2000 series (2105, 2122, 2122-5, 2126), GUR 4000 series (4120, 4130, 4150, 4170, 4012, 4122-5, 4022-6, 4050-3/4150-3), GUR 8000 series (8110, 8020), GUR X series (X143, X184, X168, X172, X192).

One example of a suitable polyethylene material is that having an intrinsic viscosity in the range of 5 dl/g to 30 dl/g and a degree of crystallinity of 80% or more as described in US Patent Application Publication No. 2008/0090081. Another example of a suitable polyethylene material is that having a molecular weight in the range of about 300,000 g/mol to about 2,000,000 g/mol as determined by ASTM-D 4020, an average particle size, $D_{50}$, between about 300 and about 1500 μm, and a bulk density between about 0.25 and about 0.5 g/ml as described in U.S. Provisional Application No. 61/330,535 filed May 3, 2010.

In one embodiment, the binder particles are combination of various binder particles. In one embodiment, the binder particles have a particle size in the range of 0.5-5000 microns. In another embodiment, the particle size may range from 10-1000 microns. In other embodiments, the particle size may range from 20-600 microns, or 125-5000 microns, or 125-1000 microns, or 150-600 microns, or 200-600 microns, or 250-600 microns, or 300-600 microns. In another embodiment, the binder particles may be a mixture of various particle sizes. In another embodiment, the binder particles may be a mixture of various particle sizes with an average particle size in the range of 125-5000 microns or 125-1000 microns or 125-600 microns.

Additionally, the binder particles may have a bulk density in the range of 0.10-0.55 g/cm$^3$. In another embodiment, the bulk density may be in the range of 0.17-0.50 g/cm$^3$. In yet another embodiment, the bulk density may be in the range of 0.20-0.47 g/cm$^3$.

In addition to the foregoing binder particles, other conventional thermoplastics may be used as binder particles. Such thermoplastics include: polyolefins, polyesters, polyamides (or nylons), polyacrylics, polystyrenes, polyvinyls, and cellulosics. Polyolefins include, but are not limited to, polyethylene, polypropylene, polybutylene, polymethylpentene, copolymers thereof, mixtures thereof, and the like.

Polyethylenes further include low density polyethylene, linear low density polyethylene, high density polyethylene, copolymers thereof, mixtures thereof, and the like. Polyesters include polyethylene terephthalate, polybutylene terphthalate, polycyclohexylene dimethylene terphthalate, polytrimethylene terephthalate, copolymers thereof, mixtures thereof, and the like. Polyacrylics include, but are not limited to, polymethyl methacrylate, copolymers thereof, modifications thereof, and the like. Polystrenes include, but are not limited to, polystyrene, acrylonitrile-butadiene-styrene, styrene-acrylonitrile, styrene-butadiene, styrene-maleic anhydride, copolymers thereof, mixtures thereof, and the like. Polyvinyls include, but are not limited to, ethylene vinyl acetate, ethylene vinyl alcohol, polyvinyl chloride, copolymers thereof, mixtures thereof, and the like. Cellulosics include, but are not limited to, cellulose acetate, cellulose acetate butyrate, cellulose propinate, ethyl cellulose, copolymers thereof, mixtures thereof, and the like.

The binder particles may assume any shape. Such shapes include spherical, hyperion, asteroidal, chrondular or interplanetary dust-like, cranulated, potato, irregular, or combinations thereof.

The porous mass is effective at the removal of componenets from the tobacco smoke. A porous mass can be used to reduce the delivery of certain tobacco smoke components targeted by the WHO. For example, a porous mass where activated carbon is used as the active particles can be used to reduce the delivery of certain tobacco smoke components to levels below the WHO recommendations. See Table 13, below. In one embodiment, the porous mass, where activated carbon is used, has a length in the range of 4-11 mm. The components include: acetaldehyde, acrolein, benzene, benzo [a]pyrene, 1,3-butadiene, and formaldehyde. The porous mass with activated carbon may reduce: acetaldehydes—3.0-6.5%/mm length of porous mass with activated carbon; acrolein—7.5-12.5%/mm length of porous mass with activated carbon; benzene—5.5-8.0%/mm length of porous mass with activated carbon; benzo[a]pyrene—9.0-21.0%/mm length of porous mass with activated carbon; 1,3-butadiene—1.5-3.5%/mm length of porous mass with activated carbon; and formaldehyde—9.0-11.0%/mm length of porous mass with activated carbon. In another example, a porous mass where an ion exchange resin is used as the active particles can be used to reduce the delivery of certain tobacco smoke components to below the WHO recommendations. See Table 14, below. In one embodiment, the porous mass, where ion exchange resins are used, has a length in the range of 7-11 mm. The components include: acetaldehyde, acrolein, and formaldehyde. The porous mass with an ion exchange resin may reduce: acetaldehydes—5.0-7.0%/mm length of porous mass with an ion exchange resin; acrolein—4.0-6.5%/mm length of porous mass with an ion exchange resin; and formaldehyde—9.0-11.0%/mm length of porous mass with an ion exchange resin.

The porous mass may be made by any means. In one embodiment, the active particles and binder particles are blended together and introduced into a mold. The mold is heated to a temperature above the melting point of the binder particles, e.g., in one embodiment about 200° C. and held at the temperature for a period of time (in one embodiment 40±10 minutes). Thereafter, the mass is removed from the mold and cooled to room temperature. In one embodiment, this process is characterized as a free sintering process, because the binder particles do not flow (or flow very little) at their melting temperature and no pressure is applied to the blended materials in the mold. In this embodiment, point bonds are formed between the active particles and the binder particles. This enables superior bonding and maximizing the interstitial space, while minimizing the blinding of the surface of the active particles by free flowing molten binder. Also see, U.S. Pat. Nos. 6,770,736, 7,049,382, 7,160,453, incorporated herein by reference.

Alternatively, one could make the porous mass using a process of sintering under pressure. As the mixture of the active particles and the binder particles are heated (or at a temperature which may be below, at, or above the melting temperature of the binder particles) a pressure is exerted on the mixture to facilitate coalescence of the porous mass.

Also, the porous mass may be made by an extrusion sintering process where the mixture is heated in an extruder barrel and extruded in to the porous mass.

The instant invention is further illustrated in the following examples.

EXAMPLES

In the following example, the effectiveness of a porous carbon mass in removing certain components of the cigarette smoke is illustrated. The carbon mass was made from 25 weight % GUR 2105 from Ticona, of Dallas, Tex. and 75 weight % PICA RC 259 (95% active carbon) from PICA USA, Inc. of Columbus, Ohio. The carbon mass has a % void volume of 72% and an encapsulated pressure drop (EPD) of 2.2 mm of water/mm of carbon mass length. The carbon mass has a circumference of 24.45 mm. The PICA RC 259 carbon had an average particle size of 569 microns (μ). The carbon mass was made by mixing the resin (GUR 2105) and carbon (PICA RC 259) and then filling a mold with the mixture without pressure on the heated mixture (free sintering). Then, the mold was heated to 200° C. for 40 minutes. Thereafter, the carbon mass was removed from the mold and allowed to cool. A defined-length section of the porous mass was combined with a sufficient amount of cellulose acetate tow to yield a filter with a total encapsulated pressure drop of 70 mm of water. All smoke assays were performed according to tobacco industry standards. All cigarettes were smoked using the Canadian intense protocol (i.e., T-115, *"Determination of "Tar", Nicotine and Carbon Monoxide in Mainstream Tobacco Smoke"*, Health Canada, 1999) and a Cerulean 450 smoking machine.

TABLE 1

| Carbonyls μg/cigarette | Control | 5 mm carbon mass 20 mm Tow | % | 10 mm carbon mass 15 mm Tow | % | 15 mm carbon mass 13 mm Tow | % |
|---|---|---|---|---|---|---|---|
| Formaldehyde | 10.4 | 5.1 | −51 | 0.0 | −100 | 0.0 | −100 |
| Acetaldehyde | 295.3 | 211.2 | −28 | 186.8 | −37 | 188.5 | −36 |
| Acetone | 601.0 | 287.7 | −52 | 104.7 | −83 | 95.4 | −84 |
| Propionaldehyde | 100.2 | 42.4 | −58 | 16.0 | −84 | 14.9 | −85 |
| Crotonaldehyde | 101.7 | 29.4 | −71 | 0.0 | −100 | 0.0 | −100 |
| Butyraldehyde | 114.8 | 43.3 | −62 | 0.0 | −100 | 0.0 | −100 |
| Methyl Ethyl Ketone | 178.8 | 64.2 | −64 | 20.8 | −88 | 21.5 | −88 |
| Acrolein | 101.8 | 45.3 | −56 | 13.6 | −87 | 14.8 | −85 |

TABLE 2

| Other compounds | Control | 5 mm carbon mass 20 mm Tow | % | 10 mm carbon mass 15 mm Tow | % | 15 mm carbon mass 13 mm Tow | % |
|---|---|---|---|---|---|---|---|
| Benzene (μg/cig) | 79.0 | 54.0 | −32 | 22.0 | −72 | 20.0 | −75 |
| 1,3 butadiene (μg/cig) | 220.0 | 192.0 | −13 | 162.0 | −26 | 98.0 | −55 |
| Benzo[a]Pyrene (ng/cig) | 5.0 | 0.0 | −100 | 0.0 | −100 | 0.0 | −100 |

TABLE 3

| Tar, nicotine, etc | Control | 5 mm carbon mass 20 mm Tow | Control | 10 mm carbon mass 15 mm Tow | Control | 15 mm carbon mass 13 mm Tow |
|---|---|---|---|---|---|---|
| Tar (mg/cig) | 39.0 | 37.1 | 35.8 | 34.4 | 33.7 | 34.9 |
| Nicotine (mg/cig) | 2.8 | 2.8 | 2.5 | 2.6 | 2.6 | 2.7 |
| Water (mg/cig) | 17.7 | 17.0 | 14.0 | 13.3 | 14.7 | 11.2 |
| CO (mg/cig) | 34.4 | 35.4 | 32.6 | 32.1 | 31.4 | 31.2 |

In the following example, the effectiveness of a porous carbon mass in removing certain components of the cigarette smoke is illustrated. The carbon mass was made from 30 weight % GUR X192 from Ticona, of Dallas, Tex. and 70 weight % PICA 30×70 (60% active carbon) from PICA USA, Inc. of Columbus, Ohio. The carbon mass has a % void volume of 75% and an encapsulated pressure drop (EPD) of 3.3 mm of water/mm of carbon mass length. The carbon mass has a circumference of 24.45 mm. The PICA 30×70 carbon had an average particle size of 405 microns (μ). The carbon mass was made by mixing the resin (GUR X192) and carbon (PICA 30×70) and then filling a mold with the mixture without pressure on the heated mixture (free sintering). Then, the mold was heated to 220° C. for 60 minutes. Thereafter, the carbon mass was removed from the mold and allowed to cool. A defined-length section of the porous mass was combined with a sufficient amount of cellulose acetate tow to yield a filter with a total encapsulated pressure drop of 70 mm of water. All smoke assays were performed according to tobacco industry standards. All cigarettes were smoked using the Canadian intense protocol (i.e., T-115, *"Determination of "Tar", Nicotine and Carbon Monoxide in Mainstream Tobacco Smoke"*, Health Canada, 1999) and a Cerulean 450 smoking machine.

TABLE 4

| Carbonyls μg/cigarette | Control | 5 mm carbon mass 20 mm Tow | % | 10 mm carbon mass 15 mm Tow | % | 15 mm carbon mass 13 mm Tow | % |
|---|---|---|---|---|---|---|---|
| Formaldehyde | 7.9 | 5.3 | −32 | 0.0 | −100 | 0.0 | −100 |
| Acetaldehyde | 477.7 | 478.0 | −0 | 413.5 | −13 | 337.8 | −29 |
| Acetone | 557.4 | 433.4 | −22 | 214.0 | −62 | 121.2 | −78 |
| Propionaldehyde | 118.5 | 72.5 | −39 | 31.6 | −73 | 17.4 | −85 |
| Crotonaldehyde | 83.0 | 38.5 | −54 | 14.5 | −83 | 10.7 | −87 |
| Butyraldehyde | 86.8 | 39.7 | −54 | 10.7 | −88 | 5.9 | −93 |
| Methyl Ethyl Ketone | 195.7 | 100.8 | −49 | 37.1 | −81 | 19.2 | −90 |
| Acrolein | 84.0 | 55.5 | −34 | 22.5 | −73 | 13.3 | −84 |

TABLE 5

| Other compounds | Control | 5 mm carbon mass 20 mm Tow | % | 10 mm carbon mass 15 mm Tow | % | 15 mm carbon mass 13 mm Tow | % |
|---|---|---|---|---|---|---|---|
| Benzene (μg/cig) | 118.7 | 82.7 | −30 | 40.1 | −66 | 23.5 | −80 |
| 1,3 butadiene (μg/cig) | 257.3 | 259.1 | 1 | 204.4 | −21 | 148.7 | −42 |
| Benzo[a]Pyrene (ng/cig) | 6.4 | 3.0 | −53 | 0.0 | −100 | 0.0 | −100 |

TABLE 6

| Tar, nicotine, etc | Control | 5 mm carbon mass 20 mm Tow | 10 mm carbon mass 15 mm Tow | 15 mm carbon mass 13 mm Tow |
|---|---|---|---|---|
| Tar (mg/cig) | 41.5 | 41.5 | 41.2 | 38.4 |
| Nicotine (mg/cig) | 2.8 | 2.8 | 2.9 | 2.8 |
| Water (mg/cig) | 16.7 | 17.0 | 17.7 | 12.6 |
| CO (mg/cig) | 30.8 | 33.2 | 35.5 | 31.6 |

In the following example, the effectiveness of a porous ion exchange resin mass in removing certain components of the cigarette smoke is illustrated. The porous mass was made from 20 weight % GUR 2105 from Ticona, of Dallas, Tex. and 80 weight % of an amine based resin (AMBERLITE IRA96RF from Rohm & Haas of Philadelphia, Pa.). A 10 mm section of the porous mass was combined with a sufficient amount of cellulose acetate tow (12 mm) to yield a filter with a total encapsulated pressure drop of 70 mm of water. All smoke assays were performed according to tobacco industry standards. All cigarettes were smoked using the Canadian intense protocol (i.e., T-115, *"Determination of "Tar", Nicotine and Carbon Monoxide in Mainstream Tobacco Smoke"*, Health Canada, 1999) and a Cerulean 450 smoking machine.

TABLE 7

| Carbonyls μg/cigarette | Control | Ion Exchange Resin | % change |
|---|---|---|---|
| Formaldehyde | 8.0 | ND | −100 |
| Acetaldehyde | 491.0 | 192.0 | −61 |
| Acetone | 519.0 | 589.0 | 14 |
| Acrolein | 65.0 | 28.0 | −56 |
| Propionaldehyde | 114.0 | 72.0 | −37 |
| Crotonaldehyde | 83.0 | 45.0 | −45 |
| Methyl Ethyl Ketone | 179.0 | 184.0 | 3 |
| Butyraldehyde | 54.0 | 61.0 | 13 |

In the following example, the effectiveness of a porous dessicant mass in removing water from the cigarette smoke is illustrated. The porous mass was made from 20 weight % GUR 2105 from Ticona, of Dallas, Tex. and 80 weight % of desiccant (calcium sulfate, DRIERITE from W. A. Hammond DRIERITE Co. Ltd. of Xenia, Ohio). A 10 mm section of the porous mass was combined with a sufficient amount of cellulose acetate tow (15 mm) to yield a filter with a total pressure drop of 70 mm of water. All smoke assays were performed according to tobacco industry standards. All cigarettes were smoked using the Canadian intense protocol (i.e., T-115, *"Determination of "Tar", Nicotine and Carbon Monoxide in Mainstream Tobacco Smoke"*, Health Canada, 1999) and a Cerulean 450 smoking machine.

TABLE 8

| mg/cigarette | Control | Dessicant Conditioned | % Change | Desiccant Unconditioned | % Change |
|---|---|---|---|---|---|
| Cambridge | 62.0 | 55.6 | −10.3 | 54.0 | −12.8 |
| Particular Matter | 15.0 | 12.8 | −15.1 | 11.2 | −25.6 |
| Water Deliveries | | | | | |
| Nicotine Deliveries | 2.7 | 2.9 | 8.0 | 2.9 | 8.0 |
| Tar Deliveries | 44.2 | 39.9 | −9.7 | 40.0 | −9.7 |
| Carbon monoxide | 35.0 | 35.9 | 2.5 | 35.0 | 0.1 |
| Tar/Nicotine Ratio | 16.5 | 13.8 | −16.4 | 13.8 | −16.4 |

In the following example, a carbon-on-tow filter element is compared to the inventive porous carbon mass. In this comparison, equal total carbon loadings are compared. In other words, the amount of carbon in each element is the same; the length of the element is allowed to change so that equal amounts of carbon were obtained. The reported change in smoke component is made in relation to conventional cellulose acetate filter (the % change is in relation to a conventional cellulose acetate filter). All filter tips consisted of the carbon element and cellulose acetate tow. All filter tips were tipped with a sufficient length of cellulose acetate filter tow to obtain a targeted filter pressure drop of 70 mm of water. The total filter length was 20 mm (carbon element and tow element). The carbon was 30×70, 60% active PICA carbon. All cigarettes were smoked using the Canadian intense protocol (i.e., T-115, *"Determination of "Tar", Nicotine and Carbon Monoxide in Mainstream Tobacco Smoke*", Health Canada, 1999).

TABLE 9

| | Total Carbon Loading = 39 mg | | Total Carbon loading = 56 mg | |
|---|---|---|---|---|
| Carbonyls | Carbon-on-tow (10 mm) % change | carbon mass (2 mm) % change | Carbon-on-tow (10 mm) % change | carbon mass (3 mm) % change |
| Formaldehyde | −24.6 | −13.7 | −32.3 | −27.6 |
| Acetaldehyde | −4.5 | −3.4 | −6.3 | −12.5 |
| Acetone | −19.7 | −33.1 | −27.3 | −49.2 |
| Propionaldehyde | −32.0 | −42.2 | −38.6 | −55.7 |
| Crotonaldehyde | −64.5 | −57.3 | −71.0 | −68.0 |
| Butyraldehyde | 7.9 | −34.4 | −8.2 | −54.4 |
| Methyl Ethyl Ketone | −35.4 | −48.3 | −45.6 | −63.2 |
| Acrolein | −22.5 | −40.3 | −31.3 | −52.6 |

In the following example, a porous carbon mass made with a highly active carbon (95% $CCl_4$ absorption) is compared with a porous carbon mass made with a lower active carbon (60% $CCl_4$ absorption). The combined filters were made using a 10 mm section of the carbon mass plus a sufficient length of cellulose acetate to reach a targeted combined encapsulated pressure drop of 69-70 mm of water. These filters were attached to a commercial tobacco column and smoked on a Cerulean SM 450 smoking machine using the Canadian intense smoking protocol (i.e., T-115, *"Determination of "Tar", Nicotine and Carbon Monoxide in Mainstream Tobacco Smoke*", Health Canada, 1999). The high active carbon was PICA RC 259, particle size 20×50, 950 activity ($CCl_4$ adsorption). The low active carbon was PICA PCA, particle size 30×70, 60% activity ($CCl_4$ adsorption). The carbon loading of each carbon mass element was 18.2 mg/mm, low active carbon, and 16.7 mg/mm, high active carbon. The data is reported in relation to a conventional cellulose acetate filter.

TABLE 10

| Carbonyls | 60% active carbon % change | 95% active carbon % change |
|---|---|---|
| Formaldehyde | −100.0 | −100.0 |
| Acetaldehyde | −65.8 | −37.0 |

TABLE 10-continued

| Carbonyls | 60% active carbon % change | 95% active carbon % change |
|---|---|---|
| Acetone | −89.9 | −83.0 |
| Propionaldehyde | −91.0 | −84.0 |
| Crotonaldehyde | −100.0 | −100.0 |
| Butyraldehyde | −100.0 | −100.0 |
| Methyl Ethyl Ketone | −100.0 | −88.0 |
| Acrolein | −90.7 | −87.0 |

TABLE 11

| Other compounds | 60% active carbon % change | 95% active carbon % change |
|---|---|---|
| Benzene | 2.6 | −72.0 |
| 1,3 butadiene | −3.2 | −26.0 |
| Benzo[a]Pyrene | −100.0 | −100.0 |

In the following example, the effect of particle size on encapsulated pressure drop (EPD) is illustrated. Porous carbon masses with carbons of various particle sizes were molded into rods (length=39 mm and circumference=24.45 mm) by adding the mixture of carbon and resin (GUR 2105) in to a mold and heating (free sintering) the mixture at 200° C. of 40 minutes. Thereafter, the carbon mass was removed from the mold and allowed to cool to room temperature. The EPD's were determined for 10 carbon masses and averaged.

TABLE 12

| Carbon | Carbon:GUR Weight Ratio | Average Particle Size (μ) | Average EPD (mm of water/mm of carbon mass length) |
|---|---|---|---|
| RC 259 | 75:25 | 569.0 | 2.2 |
| PICA | 80:20 | 402.5 | 3.5 |
| NC506 | 75:25 | 177.5 | 25.0 |

In the following example, carbon masses, as set forth in Tables 1-3, are used to demonstrate that filters made with such carbon masses can be used to manufacture cigarettes that meet World Health Organization (WHO) standards for cigarettes. WHO standards may be found in WHO Technical Report Series No. 951, *The Scientific Basis of Tobacco Product Regulation*, World Health Organization (2008), Table 3.10, page 112. The results, reported below, show that the carbon mass can be used to reduce the listed components from tobacco smoke to a level below that recommended by the WHO.

TABLE 13

| (μg) | Median[1] | Upper limit (125% of median) | Highest delivery brand[1] | % reduction[2] 5 mm | % reduction[2] 10 mm | Amount delivered 5 mm | Amount delivered 10 mm |
|---|---|---|---|---|---|---|---|
| 1,3Butadiene | 53.3 | 66.7 | 75.5 | 13 | 26 | 65.7 | 55.9 |
| Acetaldehyde | 687.6 | 859.5 | 997.2 | 28 | 37 | 718.0 | 628.2 |
| Acrolein | 66.5 | 83.2 | 99.5 | 56 | 87 | 43.8 | 12.9 |
| Benzene | 38.0 | 47.5 | 51.1 | 32 | 72 | 34.7 | 14.3 |
| Benzo[a]pyrene | 9.1 | 11.4 | 13.8 | 100 | 100 | 0.0 | 0.0 |
| Formaldehyde | 37.7 | 47.1 | 90.5 | 51 | 100 | 44.4 | 0.0 |

[1]Information based on data in Counts, ME, et al, (2004) Mainstream smoke toxicant yields and predicting relationships from a worldwide market sample of cigarette brands: ISO smoking conditions, Regulatory Toxicology and Pharmacology, 39: 111-134, and Counts ME, et al, (2005) Smoke composition and predicting relationships for international commercial cigarettes smoked with three machine-smoking conditions, Regulatory Toxicology and Pharmacology, 41: 185-227.
[2]% reductions obtained from Tables 1-3 above.

In the following example, porous mass where ion exchange resins are used as the active particles, as set forth in Table 4, are used to demonstrate that filters made with such porous masses can be used to manufacture cigarettes that meet World Health Organization (WHO) standards for cigarettes. WHO standards may be found in WHO Technical Report Series No. 951, *The Scientific Basis of Tobacco Product Regulation*, World Health Organization (2008), Table 3.10, page 112. The results, reported below, show that the porous mass can be used to reduce the certain components from tobacco smoke to a level below that recommended by the WHO.

TABLE 14

| (μg) | Median[1] | Upper limit (125% of median) | Highest delivery brand[1] | % reduction[2] 10 mm | Amount delivered 10 mm |
|---|---|---|---|---|---|
| Acetaldehyde | 687.6 | 859.5 | 997.2 | 61 | 388.9 |
| Acrolein | 66.5 | 83.2 | 99.5 | 56 | 43.8 |
| Formaldehyde | 37.7 | 47.1 | 90.5 | 100 | 0.0 |

[1]Information based on data in Counts, ME, et al, (2004) Mainstream smoke toxicant yields and predicting relationships from a worldwide market sample of cigarette brands: ISO smoking conditions, Regulatory Toxicology and Pharmacology, 39: 111-134, and Counts ME, et al, (2005) Smoke composition and predicting relationships for international commercial cigarettes smoked with three machine-smoking conditions, Regulatory Toxicology and Pharmacology, 41: 185-227..
[2]% reductions obtained from Table 4 above.

The present invention may be embodied in other forms without departing from the spirit and the essential attributes thereof, and, accordingly, reference should be made to the appended claims, rather than to the foregoing specification, as indicated the scope of the invention.

We claim:

1. A tobacco smoke filter comprising:

a porous mass comprising active particles and binder particles, said porous mass being adapted to enhance a tobacco smoke flowing over said active particles and said binder particles, said porous mass having an encapsulated pressure drop of about 10 mm of $H_2O$/mm of porous mass length or less, said active particles comprising about 1-99% weight of said porous mass, said binder particles comprising about 1-99% weight of said porous mass, said active particles and said binder particles being bound together at randomly distributed points throughout said porous mass, said active particles having a greater particle size than said binder particles, and said binder particles have a melt flow index (MFI) at 190° C. and 15 Kg of less than about 3.5 g/10 min, a bulk density of about 0.1 to about 0.55 g/cm$^3$, and either (1) a molecular weight of about 300,000 to less than 1,000,000 and an average particle size of about 5 microns to about 500 microns or (2) a molecular weight of about 1,000,000 to about 6,000,000 and an average particle size of about 200 microns to about 500 microns.

2. The tobacco smoke filter of claim 1 wherein said active particles comprise about 40-95% weight of said porous mass.

3. The tobacco smoke filter of claim 1 wherein said active particles comprise about 60-90% weight of said porous mass.

4. The tobacco smoke filter of claim 1 wherein said binder particles comprise about 5-40% weight of said porous mass.

5. The tobacco smoke filter of claim 1 wherein said binder particles comprise about 10-25% weight of said porous mass.

6. The tobacco smoke filter of claim 1 wherein said porous mass having a void volume in the range of about 40-90%.

7. The tobacco smoke filter of claim 1 wherein said porous mass having a void volume in the range of about 60-90%.

8. The tobacco smoke filter of claim 1 wherein said porous mass having a void volume in the range of about 60-85%.

9. The tobacco smoke filter of claim 1 wherein said porous mass having an encapsulated pressure drop (EPD) in the range of about 0.5-25 mm of water per mm length of said porous mass.

10. The tobacco smoke filter of claim 1 wherein said porous mass having an encapsulated pressure drop (EPD) in the range of about 0.5-10 mm of water per mm length of said porous mass.

11. The tobacco smoke filter of claim 1 wherein said porous mass having an encapsulated pressure drop (EPD) of no greater than about 7 mm of water per mm length of said porous mass.

12. The tobacco smoke filter of claim 1 wherein said porous mass having a length in the range of about 2-30 mm.

13. The tobacco smoke filter of claim 1 wherein said porous mass having a length in the range of about 4-10 mm.

14. The tobacco smoke filter of claim 1 wherein said porous mass having a cylindrical shape.

15. The tobacco smoke filter of claim 1 wherein said active particles being activated carbon.

16. The tobacco smoke filter of claim 15 wherein said activated carbon being a low activity carbon (about 50-75% $CCl_4$ adsorption).

17. The tobacco smoke filter of claim 15 wherein said activated carbon being a high activity carbon (about 75-95% $CCl_4$ adsorption).

18. The tobacco smoke filter of claim 15 wherein said activated carbon being a mixture of low activity carbon (about 50-75% $CCl_4$ adsorption) and high activity carbon (about 50-75% $CCl_4$ adsorption).

19. The tobacco smoke filter of claim 1 wherein said active particles being ion exchange resins.

20. The tobacco smoke filter of claim 19 wherein said ion exchange resins include styrene-divinyl benezene copolymer.

21. The tobacco smoke filter of claim 19 wherein said ion exchange resins include acrylates.

22. The tobacco smoke filter of claim 19 wherein said ion exchange resins include methacrylates.

23. The tobacco smoke filter of claim 19 wherein said ion exchange resins include phenol formaldehyde condensates.

24. The tobacco smoke filter of claim 19 wherein said ion exchange resins include epichlorohydrin amine condensates.

25. The tobacco smoke filter of claim 1 wherein said active particles have an average particle size in the range of about 0.5-5000 microns.

26. The tobacco smoke filter of claim 1 wherein said active particles have an average particle size in the range of about 10-1000 microns.

27. The tobacco smoke filter of claim 1 wherein said active particles have an average particle size in the range of about 200-900 microns.

28. The tobacco smoke filter of claim 1 wherein the MFI of said binder particles is less than about 2.0 g/10 min.

29. The tobacco smoke filter of claim 1 wherein the MFI of said binder particles is about 0 g/10 min.

30. The tobacco smoke filter of claim 1 wherein said binder particles being an ultra high molecular weight polyethylene (UHMWPE) with the MFI of about 0 g/10 min.

31. The tobacco smoke filter of claim 1 wherein said binder particles being a very high molecular weight polyethylene (VHMWPE) with the MFI of about 1.0-2.0 g/10 min.

32. The tobacco smoke filter of claim 1 wherein said binder particles being a high molecular weight polyethylene (HMWPE) with the MFI of about 2.0-3.5 g/10 min.

33. The tobacco smoke filter of claim 1 wherein said binder particles have a bulk density in the range of about 0.17-0.50 $g/cm^3$.

34. The tobacco smoke filter of claim 1 wherein said binder particles being selected from the group consisting of polyolefins, polyesters, polyamides, polyacrylics, polystrenes, polyvinyls, cellulosics, and combinations thereof.

35. The tobacco smoke filter of claim 1 wherein said binder particles having a spherical shape.

36. The tobacco smoke filter of claim 1 wherein said binder particles having a chrondular shape.

37. The tobacco smoke filter of claim 1 wherein said binder particles having a hyperion shape.

38. The tobacco smoke filter of claim 1 wherein said binder particles having an irregular shape.

39. The tobacco smoke filter of claim 1 wherein a ratio of binder particle size to active particle size being in the range of about 1:1.5-4.0.

40. The tobacco smoke filter of claim 1 whereby components of a tobacco smoke drawn through said porous mass being selectively removed.

41. The tobacco smoke filter of claim 40 wherein said active particles being activated carbon and said component being acetaldehydes, then said porous mass removing 3.0-6.5% weight acetaldehyde/mm length of said porous mass.

42. The tobacco smoke filter of claim 40 wherein said active particles being activated carbon and said component being acrolein, then said porous mass removing 7.5-12.5% weight acrolein/mm length of said porous mass.

43. The tobacco smoke filter of claim 40 wherein said active particles being activated carbon and said component being benezene, then said porous mass removing 5.5-8.0% weight benzene/mm length of said porous mass.

44. The tobacco smoke filter of claim 40 wherein said active particles being activated carbon and said component being benzo[a]pyrenes, then said porous mass removing 9.0-21.0% weight benzo[a]pyrenes/mm length of said porous mass.

45. The tobacco smoke filter of claim 40 wherein said active particles being activated carbon and said component being 1,3-butadiene, then said porous mass removing 1.5-3.5% weight 1,3-butadiene/mm length of said porous mass.

46. The tobacco smoke filter of claim 40 wherein said active particles being activated carbon and said component being formaldehydes, then said porous mass removing 9.0-11.0% weight formaldehyde/mm length of said porous mass.

47. The tobacco smoke filter of claim 40 wherein said active particles being ion exchange resins and said component being acetaldehydes, then said porous mass removing 5.0-7.0% weight acetaldehyde/mm length of said porous mass.

48. The tobacco smoke filter of claim 40 wherein said active particles being ion exchange resins and said component being acroleins, then said porous mass removing 4.0-6.5% weight acrolein/mm length of said porous mass.

49. The tobacco smoke filter of claim 40 wherein said active particles being ion exchange resins and said component being formaldehydes, then said porous mass removing 9.0-11.0% weight formaldehyde/mm length of said porous mass.

50. The tobacco smoke filter of claim 1 further comprising a first section joined to a second section, and said second section being said porous mass.

51. The tobacco smoke filter of claim 50 wherein said first section comprising conventional filter materials.

52. The tobacco smoke filter of claim 1 further comprising a filter section having two or more sections where one said section being said porous mass.

53. A cigarette comprising the porous mass tobacco smoke filter of claim 1 in combination with a tobacco column.

* * * * *